United States Patent [19]

Reich

[11] 4,148,367

[45] Apr. 10, 1979

[54] WELL DRILLING APPARATUS

[76] Inventor: Wendell L. Reich, P.O. Box 7391, Reno, Nev. 89502

[21] Appl. No.: 777,163

[22] Filed: Mar. 14, 1977

[51] Int. Cl.[2] ..... E21B 3/04

[52] U.S. Cl. ..... 175/171; 173/163; 175/173; 175/257; 175/88

[58] Field of Search ..... 175/57, 88, 171, 195, 175/173, 323, 257; 173/163

[56] References Cited

U.S. PATENT DOCUMENTS

| | | | |
|---|---|---|---|
| 2,946,567 | 7/1960 | Pepper | 175/323 |
| 3,390,730 | 7/1968 | Techy et al. | 175/171 |
| 3,645,343 | 2/1972 | Mays | 175/171 |
| 3,703,212 | 11/1972 | Abrahams | 175/171 |
| 3,734,212 | 5/1973 | Perlewitz | 175/171 |

FOREIGN PATENT DOCUMENTS

| | | | |
|---|---|---|---|
| 2237463 | 2/1974 | Fed. Rep. of Germany | 175/171 |

*Primary Examiner*—William Pate, III
*Attorney, Agent, or Firm*—Herbert C. Schulze

[57] ABSTRACT

This invention is a Well Drilling Apparatus primarily intended for drilling water wells, but also adaptable for other well, or hole drilling activities. The apparatus is particularly characterized by an independent driving arrangement for the drill, accompanied by an independent driving arrangement by which the casing may be turned during the drilling operation for ease of insertion and may accompany the drill into the ground to prevent collapse during drilling operations as well as to enhance the removal of drilled material.

3 Claims, 7 Drawing Figures

WELL DRILLING APPARATUS

CROSS REFERENCE TO RELATED PATENT APPLICATIONS

There are no related patent applications filed by me.

BACKGROUND OF THE INVENTION

1. FIELD OF THE INVENTION

This invention is in the general field of drilling apparatus, and is more particularly directed to an improved well drilling apparatus which is also suitable for drilling holes of any nature, and is particularly directed to the drilling apparatus in which a casing for the hole being drilled may be inserted simultaneously with the drill and/or independently thereof, and may be turned in any relationship to the action of the drill.

2. DESCRIPTION OF THE PRIOR ART

There have been many drills, post-hole auguring devices, and the like, made for special purposes and for general hole drilling purposes. Some of such devices provide for insertion of well casing material, which consists of a hollow cylinder of metal or the like to prevent cave in of the hole after it is drilled. Such casing may frequently have perforations at various points to allow liquid, such as water, to enter the casing. It is recognized that there are cooperative provisions for the insertion of casing into the well during the well drilling operation. However, we have developed a new method and an apparatus for practicing that method, wherein the well casing may be turned coincidently with, or independent of, the drill, and accompany the drill into the ground. We accomplish this by a pair of clamping rings and interlocking bosses allowing the operator to make full adjustment and to operate the casing independently of, or in conjunction with, the drilling. In this respect there is no prior art.

SUMMARY OF THE INVENTION

The drilling of wells for water, and for other purposes, is a large industry. In many instances, when wells are drilled, casing is then inserted to prevent collapse of the soil around the hole and, thus, destroying the well.

Frequently, the insertion of casing is a difficult and tedious process, and, in some instances, over-size holes will be drilled to accommodate a smaller size casing. A gradual collapsing about the casing then takes place later.

In many instances, the drill may pass through stratas of soil which are susceptible to instantaneous collapse, making the insertion of the casing very difficult.

In some cases, casing is inserted virtually simultaneously with the drill, but frequently this becomes a difficult process due to the tendency of the casing to bind within the hole due to action of stones or the like during its insertion.

I have now developed a method, and an apparatus for performing that method, wherein well drilling, and particularly water well drilling may be accomplished very quickly and at a lower cost than by the method and apparatus heretofore available.

In my method and apparatus, a well drilling arrangement of generally customary configuration is used, but in addition, a casing turning and insertion apparatus is utilized so that casing may be inserted simultaneously with, and about, the drill.

In use of my method and apparatus, the casing may be inserted in such a manner that at all times it is in essentially firm and complete contact with the surrounding soil so that there is no collapsing whatsoever of the soil, but only the drilling. The drill operates within the casing and the soil being removed from the hole travels upward through the casing and forms within a collector ring at the top and is expelled in a neat manner to the side.

The casing-turning mechanism is an independent mechanism wherein the casing may be gripped above or below the casing-turning mechanism, and this mechanism may be lowered into the ground at a rate equal to (or, if desired, not equal to) the rate of the drill.

A pair of casing clamping arrangements have been provided so that an operator may operate this device from ground level at all times, and, thus, will not be required to climb into the well drilling superstructure or use a ladder or other lift to make necessary connections and adjustments.

It is an object of this invention to provide a well drilling apparatus wherein casing may be inserted into the hole being drilled simultaneously with the drilling;

Another object of this invention is to provide such a device and method as above set forth wherein the casing may be turned as it enters the ground to avoid binding during an otherwise plain vertical descent;

Another object of this invention is to provide such a method and apparatus as indicated wherein the casing-turning mechanism may be adjusted and clamped both above and below the basic mechanism so that an operator need not work at an elevation above ground level or truck platform level.

The foregoing and other objects and advantages will become apparent to those skilled in the art upon reading the description of the preferred embodiment which follows in conjunction with a review of the appended drawings.

DESCRIPTION OF A PREFERRED EMBODIMENT

Figure 1:
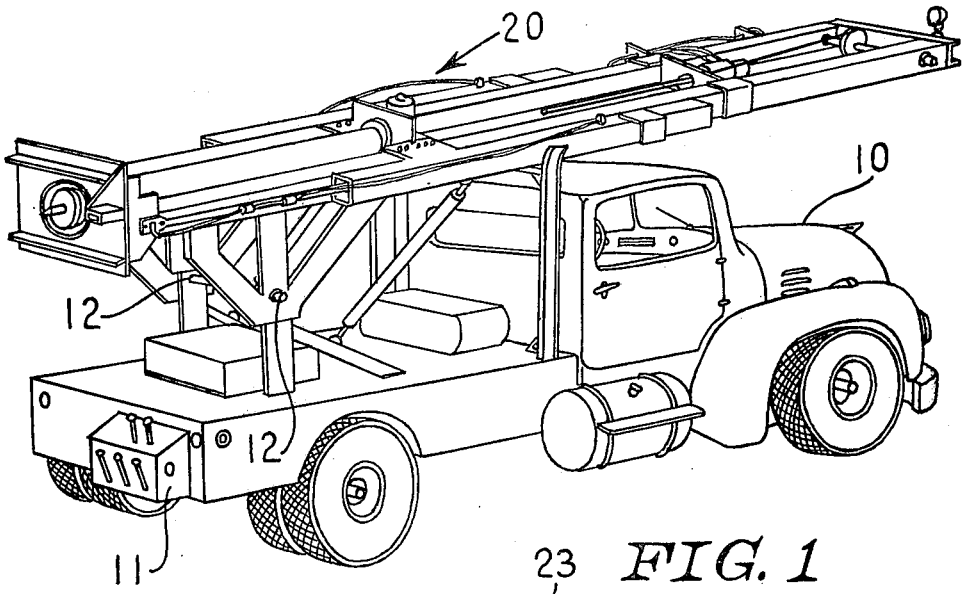
FIG. 1 is a perspective of a preferred embodiment of an apparatus to practice the method of this invention in transit.

FIG. 1 illustrates a preferred embodiment 20 of an apparatus to practice the method of this invention upon a truck 10 as is customary in the drilling apparatus business. A control center 11 provides the necessary controls for operation of the drilling apparatus 20.

Figure 2:
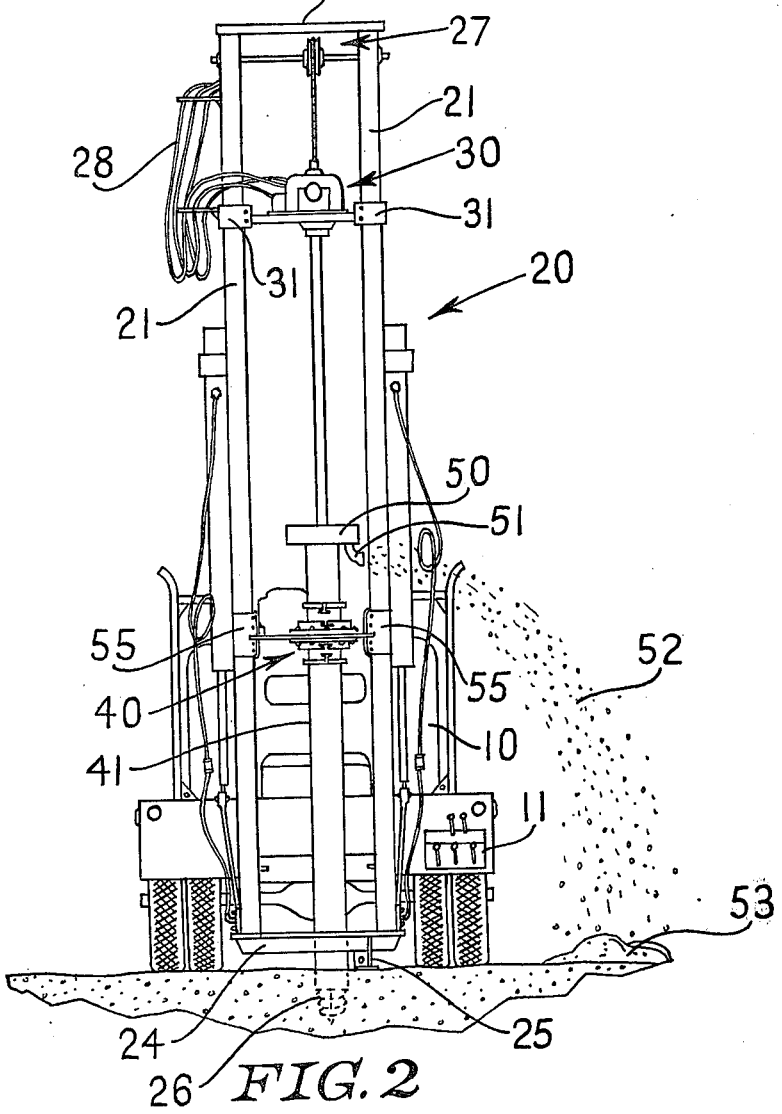
FIG. 2 is a rear elevational view of the apparatus of FIG. 1 wherein the apparatus is in place and actually drilling a well.

In FIG. 2, the apparatus is shown in vertical position which has been accomplished by pivoting the apparatus 20 about pivot points 12 in a manner known to those skilled in the art. With the apparatus firmly in position as shown in FIG. 2, many of the features are customary and are not discussed in detail since one skilled in the drilling art will understand them. A framework, consisting of upright members 21 and upper and lower members 23 and 24, respectively, is illustrated. A fitting 25 is provided to secure contact with the ground and avoid twisting or the like during the drilling operation. There are many other elements of the frame which need not be described since one skilled in the art will understand this. The drill 26 is shown penetrating the earth, and hoisting mechanism 27, of customary construction, may be utilized to raise the drill. This will be controlled by hydraulic or other appropriate means through hydraulic lines or the like 28, none of which have been specifically described, since hydraulic lines and their functions as set forth herein are known in the art.

Customarily, the root of the drilling motor, gear box, and the like, 30 will force the drill downward into the ground at the desired rate. The drill motor and the like 30 will slide upon appropriate sleeves 31 located upon upright frame members 21, in a means known to those skilled in the art. These elements can be bushings of one type or another, lineal bearings, or other suitable devices.

Casing 31 is shown entering the ground and carried by and powered by casing drive generally 40. A dirt collector ring 50, of customary construction, is shown at the top of the casing with discharge element 51 discharging drilled material 2 which is accumulating as a pile at 53.

Figure 3:
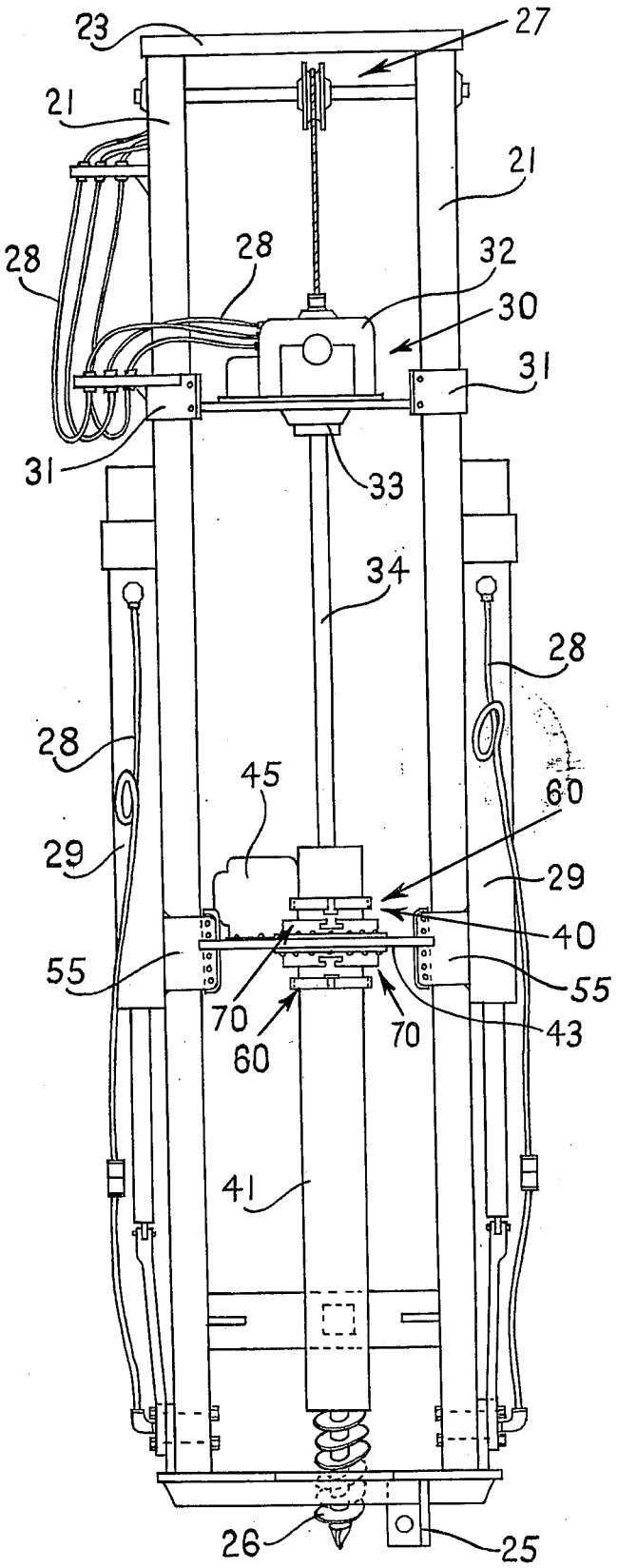
FIG. 3 is an enlarged view of the apparatus for drilling shown in FIG. 2, but wherein the drill apparatus is shown in a slightly different position with some elements removed for clarity and for the purpose of explaining the basic elements of the apparatus.
Figure 4:
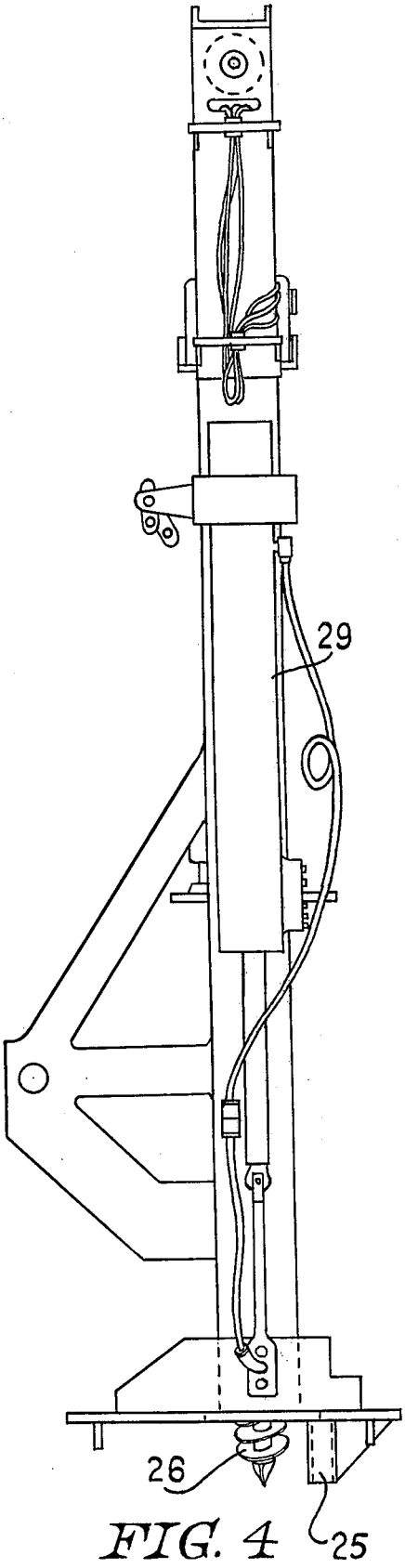
FIG. 4 is a side view of FIG. 3.

Turning now to FIG. 3, slightly more detail is shown wherein the drilling head 30 is seen to include an appropriate drive unit 32 powered by hydraulic lines 28. As previously mentioned, all hydraulic lines have been indicated as 28, without particular distinguishment between them, since the manner of hydraulic lines and controls is well known. The lifting mechanism 27 includes an hydraulic control, such as a motor, which is not shown in FIG. 3, but which is known to those skilled in the art and will be located somewhere within or beyond the upright element 21 adjacent to hoses. The drill 26 will be connected by a series of drill pipes 34 in a manner known to those skilled in the art. The drill pipe 34 will be connected to the drive at 33, once again by means known in the art.

The unique features of this device are illustrated generally at 40, which is the mechanism which powers the casing 41. This consists of clamp elements 60 and clamp locking and driving elements 70 together with appropriate drive table 43 and drive unit 45. The entire mechanism 40 is controlled by and carried by a pair of sliding bushing elements or the like 55 which run vertically up and down on upright elements 21. They are carried by, and raised or lowered by, hydraulic cylinders 29 of generally customary construction which will be understood by those skilled in the art. The motion of the hydraulic cylinders 29 is controlled through appropriate hydraulic lines 28, the details of which are not shown, but it is understood that these will be double-acting cylinders generally, although they can be single-acting cylinders relying upon the weight of the element for the downward movement and utilized only to raise the element if desired.

Figures 5, 7:
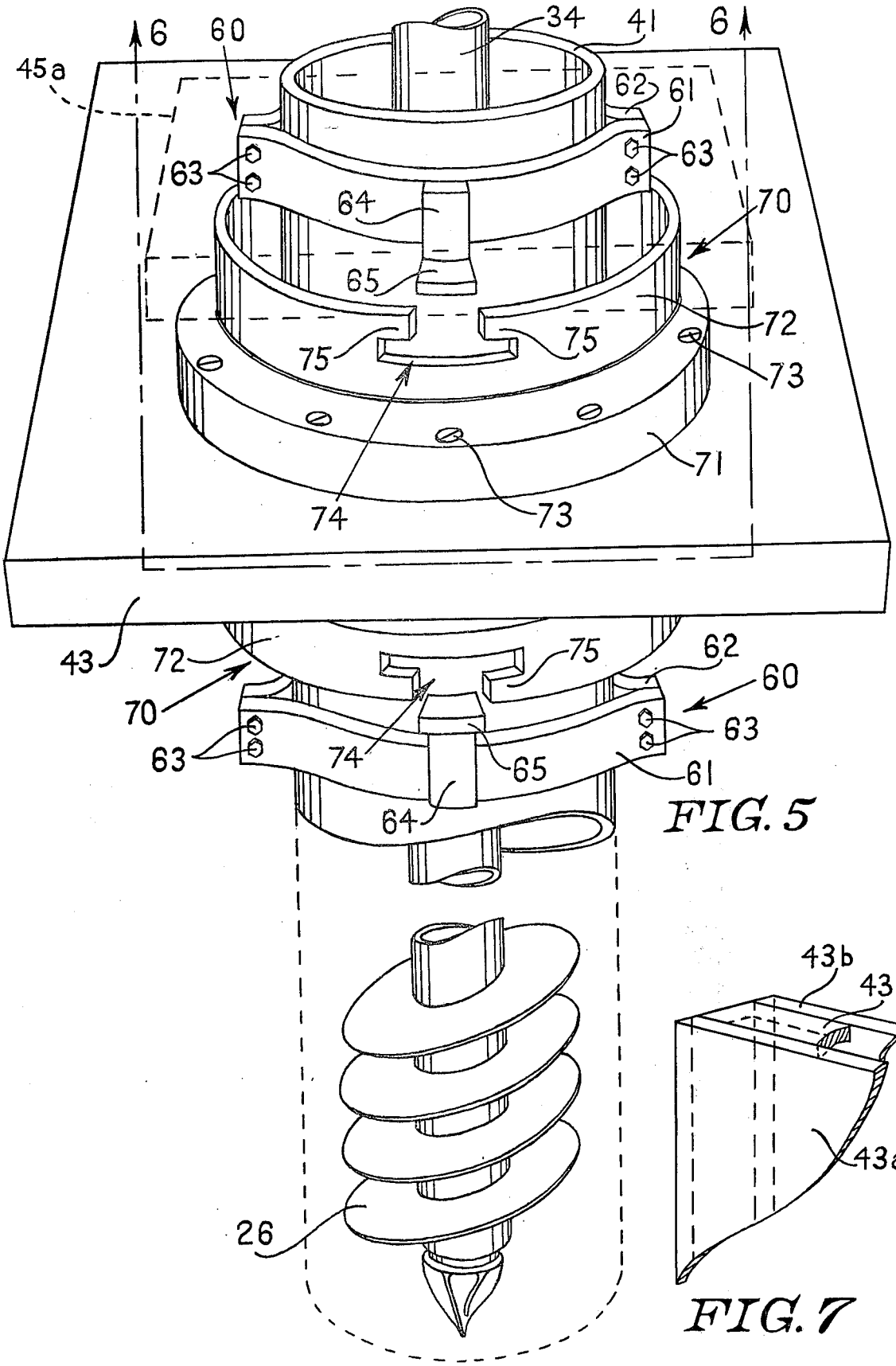
FIG. 5 is an enlarged, partially broken away perspective of the elements constituting the casing-turning portion of the apparatus shown in the foregoing figures.
FIG. 7 is a broken away corner of the drive table 43 of FIG. 5.

The essentials of the invention and apparatus to practice the method of this invention are best illustrated by turning to FIG. 5. The drill 26 is illustrated somewhat out of proportion in order to show adequate clearance to the casing. The drill may, in fact, be very close to a direct fit within the casing. The casing 41 is shown to have a pair of clamping elements 60, one above and one below the pair of drive elements 70, which will be described in more detail. Each clamp 60 comprises a pair of clamp elements 61 and 62 fastened together with bolts or the like 63 and clamped upon the casing 41 in this manner. At least one of the clamp elements will have a welded, or otherwise appropriately affixed, support member 64 with an angularly depending boss or the like 65.

At this point, it should be observed that while a pair of clamping elements have been shown, it would be conceivable, but not as convenient, to use one clamping element which would carry the locking device 65. Likewise, more than two units for clamping could be used.

It should also be observed that two of the elements 65 could be affixed, one to each side of the clamp, and two of the mating drive slots generally 74 could be on each side of each collar 70, as will be hereinafter described.

Attention should be now directed to the mounting element 43 which is a hollow box-like member formed of steel or the like, which member carries within its hollow inner space the drive mechanism which will be described in FIG. 6. A pair of flanges 71 (only one of which is seen in FIG. 5 because of the angle, but both of which may be viewed in FIG. 3) will be bolted together by a series of bolts 73 or the like, one on each side of the hollow element 43.

Each flange 71 will have welded, or otherwise affixed thereto, a collar 72. Each collar 72 will have at least one essentially "T"-shaped slot 74 as illustrated. The T-shaped slot will, of necessity, cause the opening as illustrated with two tabs 75 extending toward one another as indicated. The space between the two tabs 75 will be sufficient to accommodate the passage of member 65 therethrough.

During the drilling operation, when desired, the drilling head generally 40 will be either raised or lowered so that the appropriate upper or lower boss 65 will pass through the slot. Thereafter, upon engaging the power of the driving head, the boss 65 will be held in place with relation to one or another of the tabs 75 and, as the driving head 40 is raised or lowered and/or turned, the casing 41, being held by the clamp arrangements 60 will accompany the driving head in whatever direction it takes.

The drive for the driving head will be an appropriate motor or the like 45 (see FIG. 3) which will be located more or less on the area 45A shown on FIG 5. The actual drive motor itself is not shown for clarity of this illustration.

Figure 6:
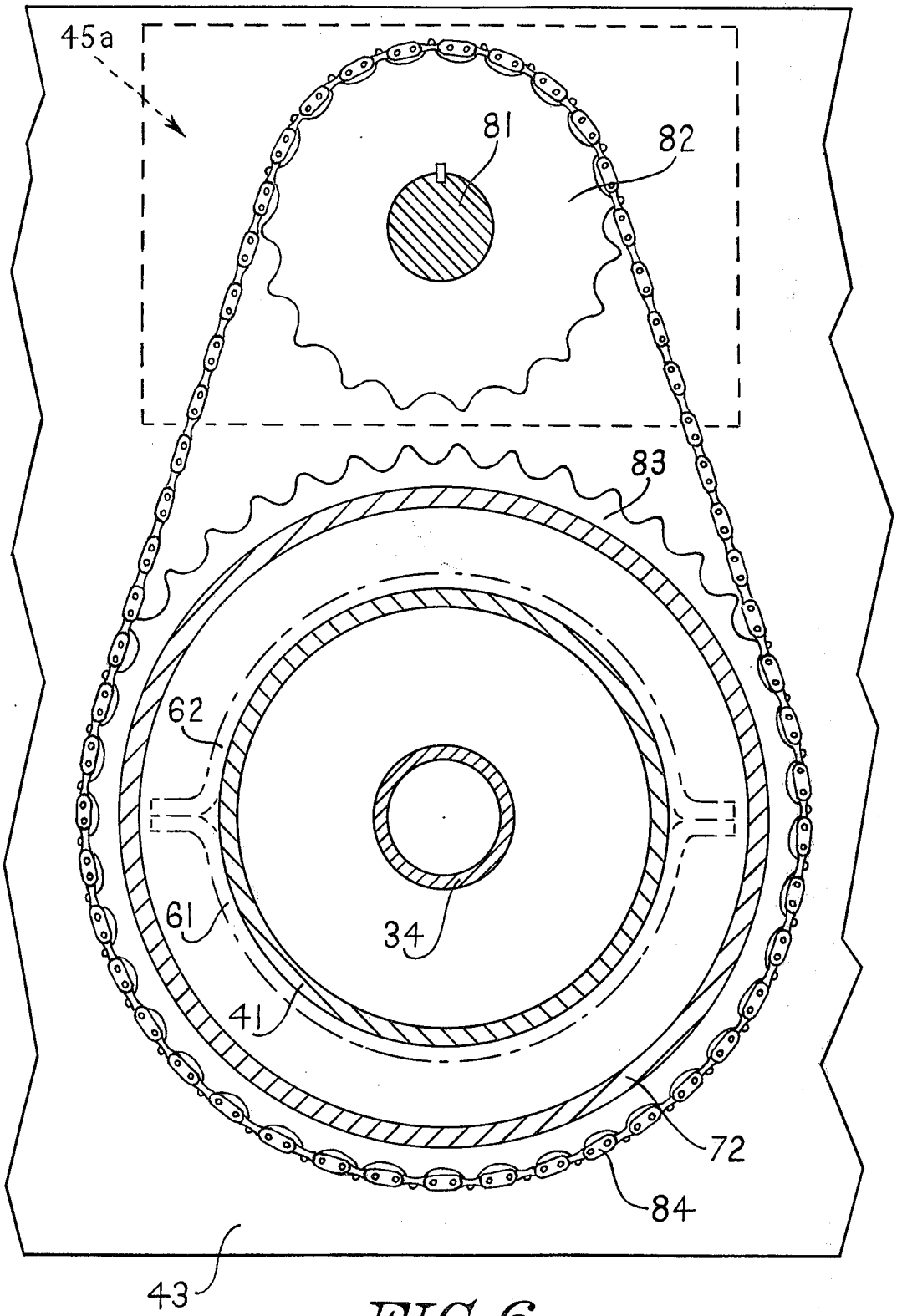
FIG. 6 is a broken away, schematic, sectionalized view of the means of driving the casing-turning mechanism shown in the foregoing figures.

Turning attention to FIG. 6, it will be noted that a shaft 31 will be attached to the drive 45 (not shown) and it will carry sprocket 82. Ring sprocket 83 will be welded, or otherwise properly affixed, to the collar 72 which passes between the two flanges 71 and will thus drive, by the means previously described, the clamp elements 61 and 62 when properly engaged and, thus, will in turn drive casing 41.

It will be noted that there is a wide difference in size between the casing and the drive collar 72. This is purposeful and allows for a wide range of casing sizes to be utilized within the one drive mechanism.

Turning attention to FIG. 7, there is shown a fragmentary view of the construction of element 43 showing it is composed of upper and lower plates 43A and 43B, and a spacer element between said plates around the edge thereof, such spacer element being indicated as 43C. This will normally be comprised for four individual bars covering the four edges between the two plates.

While the embodiment of this invention as shown and described is fully capable of achieving the objects and advantages desired, it is to be understood that such embodiment has been so illustrated and described solely for purposes of illustration, and not for limitation.

I claim:

1. Apparatus for drilling a well comprising: (1) a frame; (2) a drill carried in a slideable relation to said frame; (3) means to turn said drill carried in slideable relation to the frame in such manner as to power said drill; (4) means to carry a drill casing about the said drill mounted in slideable relationship on said frame; (5) means cooperatively attached to said casing to cause the same to turn, including a motor slideably carried by said frame and clamp means clamping upon said casing, said clamp means including a lip which interlocks with slots in engaging means driven by said motor.

2. The apparatus of claim 1 wherein there are two sets of engaging means.

3. The apparatus of claim 2 wherein the said clamp means may be affixed either above or below the said engaging means.

* * * * *